United States Patent [19]

Harris

[11] 4,329,147

[45] May 11, 1982

[54] WETTING SOLUTION FOR USE IN CONTINUOUS DYEING OF POLYAMIDE FABRIC

[75] Inventor: Paul W. Harris, Richmond, Va.

[73] Assignee: Allied Chemical Corporation, Morris Township, Morris County, N.J.

[21] Appl. No.: 215,966

[22] Filed: Dec. 12, 1980

[51] Int. Cl.[3] ..... D06P 1/62; B01F 17/00; B01F 17/02; B01F 17/12

[52] U.S. Cl. ..... 8/636; 8/495; 8/587; 252/351; 252/353; 252/354; 252/557; 252/174.21

[58] Field of Search ..... 8/495, 587, 636, 907, 8/908; 252/351, 353, 354, 557, 174.21

[56] References Cited

U.S. PATENT DOCUMENTS

| | | | |
|---|---|---|---|
| 1,843,420 | 2/1932 | Gunther et al. | 252/354 |
| 2,028,091 | 1/1936 | Jaeger | 252/354 |
| 2,291,634 | 8/1942 | Katzman et al. | 252/354 |
| 2,307,047 | 1/1943 | Katzman et al. | 252/354 |
| 2,645,615 | 7/1953 | Pollok | 252/354 |
| 2,969,332 | 1/1961 | Lawler et al. | 252/557 |
| 3,428,560 | 2/1969 | Olsen | 252/8.7 |
| 3,449,261 | 6/1969 | Ross et al. | 252/353 |
| 3,922,141 | 11/1975 | Appenzeller et al. | 8/500 |
| 4,134,839 | 1/1979 | Marshall | 8/115.6 |
| 4,189,302 | 2/1980 | Toland | 8/480 |
| 4,190,545 | 2/1980 | Marshall et al. | 8/115.6 |
| 4,192,754 | 3/1980 | Marshall et al. | 252/8.8 |
| 4,193,880 | 3/1980 | Marshall | 8/115.6 |
| 4,209,610 | 6/1980 | Mares et al. | 260/40 R |

*Primary Examiner*—Maria Parrish Tungol
*Attorney, Agent, or Firm*—Virginia S. Andrews

[57] ABSTRACT

A wetting solution for use in a continuous dyeing process for a fabric comprised of synthetic polymer fibers characterized by a surface energy of about 18 to 20 dynes per centimeter is provided. This solution comprises water, a surfactant having a wetting speed factor of up to 1.75, and a thickening agent. A continuous dyeing process for treating the fabric is also disclosed.

60 Claims, No Drawings

WETTING SOLUTION FOR USE IN CONTINUOUS DYEING OF POLYAMIDE FABRIC

BACKGROUND OF THE INVENTION

1. Field of the Invention

The present invention relates to a wetting solution. More particularly, the present invention relates to a wetting solution for use in a continuous dyeing process for a fabric comprised of synthetic polymer, preferably either polyester or polyamide, fibers characterized by a surface energy of about 18 to 20 dynes per centimeter. The present invention also relates to the continuous dyeing process for treating this fabric.

2. Description of the Prior Art

Continuous dyeing processes for fabric made from synthetic polymer fibers are known. See, for example, U.S. Pat. No. 3,922,141 to Appenzeller et al. and U.S. Pat. No. 4,189,302 to Toland, both of which are hereby incorporated by reference. Such processes typically involve several treating stages. The fabric is initially immersed for prewetting or wetting out in an aqueous solution of a nonionic or anionic surfactant followed by squeezing, e.g., between nip rollers, to a desired wet pickup level. This prewetting step prepares the fabric to permit uniform application and penetration of dye(s). The fabric subsequently has dye(s) applied thereto and is steamed to set the dye(s). Printing and the application of gum may optionally occur prior to dyeing the fabric.

Most wetting solutions utilized in a continuous dyeing process are incapable of completely prewetting, in the short time available, a tufted fabric comprised of polyamide fibers characterized by a low surface energy of about 18 to 20 dynes per centimeter. See for examples of some of these fibers U.S. Pat. No. 4,134,839 to Marshall; U.S. Pat. No. 4,190,545 to Marshall et al.; U.S. Pat. No. 4,192,754 to Marshall et al.; U.S. Pat. No. 4,193,880 to Marshall; and U.S. Pat. No. 4,209,610 to Mares et al.; and U.S. Application No. Ser. No. 102,588 filed Dec. 12, 1979, now U.S. Pat. No. 4,283,292 all of which are hereby incorporated by reference. After being dyed, these fibers, when looked at in side elevation, have color at their tips and roots but not in between. It is believed that this is due to the wetting solution beading up initially and then going to the bottom of the fiber where it is held due to the capillary action between the fiber and fabric backing; when dye is applied, it appears at these two extremes. Even the use of faster wetting surfactants, e.g., sodium dioctyl sulfosuccinate, does not promote the formation of a uniform film of liquid on the fiber surface.

SUMMARY OF THE INVENTION

The present invention provides a wetting solution for use in the continuous dyeing of a fabric comprised of synthetic polymer, preferably polyester and polyamide, fibers characterized by a surface energy of about 18 to 20 dynes per centimeter. The solution comprises water; about 1.44 to 15.0, more preferably about 1.44 to 3.75, grams per liter of water, of a surfactant having a wetting speed factor of up to 1.75; and a sufficient amount of a thickening agent to bring the viscosity of the solution to about 10 to 100 centipoises. Lower viscosities do not promote film formation of the wetting solution and higher viscosities retard initial penetration of the wetting solution.

The preferred surfactants are sodium dioctyl sulfosuccinate, sodium dinonyl sulfosuccinate and an ethoxylated mixture of straight chain $C_9$–$C_{11}$ alcohols. Also, the salts of dialkyl sulfosuccinates useful in this invention are the ammonium salt and the alkali metal, particularly sodium and potassium, salts of a dialkyl ester of sulfosuccinic acid.

The preferred thickening agent is a natural gum such as guar, and the preferred amount of thickening agent is 0.5 to 2.5 grams per liter of water. Lower amounts of thickening agent result in lower viscosities which retard film formation of the wetting solution as previously mentioned; higher levels take longer than the time available in the continuous dyeing process to wet the fabric.

The present invention also provides a continuous dyeing process for fabric comprised of synthetic polymer fibers characterized by a surface energy of about 18 to 20 dynes per centimeter. The process comprises the step of prewetting the fabric by immersing it for about 0.5 to 2.0 seconds in a solution as previously described. The fabric is subsequently dyed.

The wetting solution and process of the present invention are thought to promote more uniform film formation and to retard beading, although complete wetting still does not occur. Stripes in finished carpet due to uneven dyeing do not occur when utilizing the present invention.

Throughout the present specification and claims, the term "yarn" is employed in a general sense to indicate strand material, either textile or otherwise, and including a continuous, often plied, strand composed of fibers or filaments, or a noncontinuous strand such as staple and the like. The term "yarn" also is meant to include fiber, such as continuous single filaments of a yarn, or individual strands of staple fiber before drafting and spinning into a conventional staple yarn. The term "fabric" includes fabrics used in apparel, upholstery, draperies, and similar applications, as well as carpets. The phrase "synthetic polymer" generally includes any fiber-forming thermoplastic resin, such as polypropylene, polyamide, polyester, polyacrylonitrile and blends thereof.

The viscosity of the wetting solution is determined by utilizing a Brookfield viscometer at a temperature of 26.6° C. (80° F.) with a Number 2 spindle at 20 revolutions per minute.

The wetting speed factor must be determined for the particular fiber utilized as well as fabric construction. The greige fabric assessed in the wetting speed factor procedure (defined below) was made as follows. Polycaproamide polymer having about 27±1 amine end groups and about 20 carboxyl end groups, a formic acid viscosity of about 55±2.0 and an extractables level of less than about 2.8 percent, was supplied at a rate of about 125 pounds per hour per spinnerette (250 pounds per hour per position) to a spinning position which comprised two spin pots, each containing one spinnerette. Each spinnerette had 300 Y-shaped orifices. The filaments were extruded from each spinnerette into a quench stack for cross-flow quenching. Each end of quenched filaments had the spin finish described below applied at a wet pickup sufficient to achieve about 0.16 percent by weight of yarn, of the fluorochemical compound described in U.S. Pat. No. 4,192,754 to Marshall et al., on the yarn. The yarn was subsequently deposited in a tow can. The undrawn denier per filament of the yarn was about 50, and the modification ratio was between about 2.9 to 3.4. Subsequently, yarn from several tow cans was combined in a creel into a tow and was stretched in a normal manner at a stretch ratio of about 2.9 in a tow stretcher. The tow was then fed through a stuffing box crimper using 10 pounds of steam to produce about 11 crimps per inch and deposited in an autoclave cart for batch crimp setting at about 107° C.–113° C. (225° F.–235° F.). At the end of the autoclave cycle, the tow was fed into a conventional cutter, was cut into staple yarn, had a lubricating overfinish applied (Quadralube 7A, Manufacturers Chemicals Corporation, P.O. Box 197, Cleveland, Tenn. 37311) and was baled.

The spin finish was prepared as follows. About 2.53 parts of Fluorochemical Composition-1 (see U.S. Pat. No. 4,192,754 to Marshall et al.) were added to 1.27 parts of a solution which consisted essentially of about 70 percent by weight of sodium dioctyl sulfosuccinate, about 16 percent by weight of propylene glycol, and about 14 percent by weight of water. The solution is manufactured under the trade name of Aerosol OT-70-PG and is obtainable from the American Cyanamid Company, Industrial Chemicals Division, Process Chemicals Department, Wayne, N.J. 07470. The Fluorochemical Composition-1 and solution were heated to 90° C., at which temperature the Fluorochemical Composition-1 melted and formed a clear homogeneous first noncontinuous phase. This first noncontinuous phase was then added to 90 parts of water heated to about 90° C., and the mixture was agitated to form an emulsion which was then cooled to about 60° C. The oil particles in this emulsion had a particle size of less than 1 micron. To this emulsion was added 6.2 parts of a second noncontinuous phase consisting essentially of about 50 percent by weight of coconut oil, about 30 percent by weight of polyoxyethylene oleyl ether containing about 10 moles of ethylene oxide per mole of oleyl alcohol and about 20 percent by weight of polyoxyethylene stearate containing about 8 moles of ethylene oxide per mole of stearic acid.

The cut, staple yarn was characterized by a cotton count of 3.00/2 and a twist of 4.7Z by 3.9S. The yarn was Suessen heat set at a temperature of about 200° C. and a speed of 650 meters per minute, steam frame 0.20 bars and chamber steam 0.17 bars. The cut, staple yarn was tufted into a carpet having 3/16 inch (0.38 cm) gauge cut pile, pile height of 7/8 inch (2.2 cm), a weight of 40 ounces per square yarn and a backing of Typar.

WETTING SPEED FACTOR PROCEDURE

Two-inch (5.08 cm) square samples of test fabric are cut. Fabric surface should be smooth (not wrinkled) and stray, nonperpendicular tufts should be trimmed from edges.

1. Test solution (see below) is placed in test vessel (wide mouthed beaker) and adjusted to proper temperature [26.6° C. (80° F.) for standard "cold" conditions]. Test vessel should be wide enough to prevent touching fabric sample to sides.

2. Fabric sample is dropped pile-side down from a height of one inch (2.54 cm) above test solution squarely onto the surface of the liquid. Fabric sample can be dropped more precisely by using forceps. Note: Surface of liquid should be free of excessive foam for best accuracy.

3. A stopwatch is started immediately upon contact of the fabric with the liquid surface.

4. The stopwatch is stopped when liquid just completely covers the fabric backing and the fabric sinks just below the surface. The resulting time is wetting speed.

5. Three such trials are averaged.

6. Bichem Penetrant SS-75, available from Burlington Industries, Inc., P.O. Box 111, Burlington, N.C. 27215 and containing sodium dioctyl sulfosuccinate as active ingredient, is utilized as the control wetting agent, having wetting speeds at concentrations of 5 to 10 grams per liter of water, of 137 and 92 seconds, respectively. Other wetting agents are assigned a wetting speed factor by dividing their wetting speed by that of the control.

DESCRIPTION OF THE PREFERRED EMBODIMENT

Several wetting agents were evaluated in accordance with the procedure above to determine their wetting speed factor. Results are tabulated in Table I.

TABLE I

WETTING SPEED FACTORS

| | 5 g/Liter Time | | 10 g/Liter Time | |
|---|---|---|---|---|
| Wetting Agent | (Seconds) | Factor | (Seconds) | Factor |
| Bichem Penetrant SS-75[1] | 137 | 1.0 | 92 | 1.0 |
| Warcolene® K-70[2] | 690 | 5.0 | 530 | 5.8 |
| Warcolene® SS-7[2] | 138 | 1.0 | 86 | 0.9 |
| Mitchco GE | 487 | 3.6 | 321 | 3.5 |
| Warcolene® 916[2] | 125 | 0.9 | 83 | 0.9 |
| Warcolene® C-60[2] | 260 | 1.9 | — | — |
| Nekal WS-25[3] | 125 | 0.9 | — | — |

[1]Product of Burlington Chemical Co., Inc., P.O. Box 111, Burlington, North Carolina 27215. Bichem Penetrant SS-75 has sodium dioctyl sulfosuccinate as an active ingredient.

[2]Products of Sun Chemical Corporation, P.O. Box 70, Chester, South Carolina 29706. Warcolene® SS-7 has sodium dioctyl sulfosuccinate as an active ingredient; Warcolene® 916 is 100 percent active ethoxylated (6EO) mixed straight chain $C_9$–$C_{11}$ alcohols.

[3]Product of GAF Corporation, 140 West 51st Street, New York, New York 10020. Nekal WS-25 is a solution of water, isopropanol and sodium dinonyl sulfosuccinate.

The amount of thickening agent is critical, as shown in Table II where the concentration of guar gum is varied in a wetting solution containing 10 grams per liter of water, of Nekal WS-25. Wetting time is determined in accordance with the procedure above.

TABLE II

CONCENTRATION OF THICKENING AGENT

| Guar Gum (g/Liter) | Wetting Time (Seconds) |
|---|---|
| 0 | 0 |
| 0.1 | 5 |
| 0.5 | 3 |
| 0.75 | 7 |
| 1.0 | 7.5 |
| 1.5 | 9 |
| 2.0 | 12.5 |
| 2.5 | 37.5 |
| 3.0 | 65 |

The wetting solution is preferably formed as follows. The thickening agent is added to some of the water. The solution is permitted to swell to maximum viscosity, and then the surfactant is added. Water is then added to the proper concentration. Ambient temperatures, generally 26.6° C. (80° F.) are used.

The invention will now be further described in the following specific examples which are to be regarded solely as illustrative and not as restricting the scope of the invention. In the following examples, parts and percentages employed are by weight unless otherwise indicated.

EXAMPLE 1

A typical procedure for obtaining polymer pellets for use in this example is as detailed in Example 3 of U.S. Pat. No. 4,192,754 to Marshall et al. Polyamide polymer pellets prepared in accordance, generally, with that procedure were melted at about 285° C. and melt extruded under pressure of about 1500 psig through a 70-orifice spinnerette to produce an undrawn yarn having about 3600 denier. The spin finish previously described was applied to the yarn at a wet pickup sufficient to achieve desired percent by weight of the yarn of the fluorochemical compound on the yarn. The yarn was then drawn at about 3.2 times the extruded length and textured with a steam jet at a temperature of about 140° C. to 180° C. to produce a bulked yarn. The drawn denier was 1125. The yarn was two ply and nontumbled heat set. Several different yarns having decreasing levels of Fluorochemical Composition-1 were tufted in individual bands to form a carpet having the following characteristics: 3/16 inch (0.48 cm) gauge cut pile (beam creel), 30 ounces per square yard, ⅝ inch (1.59 cm) greige pile height, woven polypropylene primary, 100 feet (30.5 m) in length. There were six bands of carpet, A through F, having the following respective measured amount of Fluorochemical Composition-1 therein: zero, 0.19; 0.15; 0.12; 0.07 and 0.20 weight percent, based on the weight of the yarn. This banded, cut pile carpet, treated with varying levels of finish to achieve different weight percents of Fluorochemical Composition-1, were dyed and evaluated as follows.

Procedure 1

Thirty (30) feet (9.14 m) of the carpet were wet out in an aqueous solution containing 10 grams per liter of water, of Nekal WS-25, 100 percent wet pickup, pH of 7.7, viscosity less than 10 centipoises. The carpet was then printed with the following: Acid Orange 156, Acid Red 361, Acid Blue 277 m viscosity 1700 centipoises, pH 4.6. The carpet then had gum, viscosity 4500 centipoises and pH 7.0, applied. The carpet was then flooded with dye with a Kuster applicator (see U.S. Pat. No. 3,922,141 above) with a dye solution of: Acid Yellow 219, Acid Red 361, Acid Blue 277 with 2.0 grams per liter of Hostapur CX, viscosity 50 centipoises, pH 6.9, 100 percent wet pickup. Following the Kuster flood, the carpet traveled horizontally for about 30 seconds prior to loop and a vertical climb to steamer where it was steamed.

Procedure 2

Same as Procedure 1 except with Kuster dye solution viscosity of 100 centipoises.

Procedure 3

Forty (40) feet (12.2 m) of the carpet were treated according to Procedure 2 except the wet out solution contained 13.7 grams per liter of water, of Nekal WS-25, 100 percent wet pickup, pH of 4.0, and sufficient thickening agent to bring the viscosity up to 50 centipoises.

RESULTS

Procedure 1 Carpet

Excellent penetration of Kuster flood into carpet before going into loop, of bands A and F. Poor penetration at rest of bands leading to dye solution running back down bands as carpet moved vertically to steamer and resulting in washed out print patterns.

Procedure 2 Carpet

Same as Procedure 1 carpet but with poorer penetration on all bands.

Procedure 3 Carpet

Poor penetration of band A with improved penetration at other bands and band F excellently penetrated.

Conclusions

The increased viscosity of the wetting solution through use of the thickening agent resulted in substantially improved penetration for fabric comprised of fibers characterized by a surface energy of about 18 to 20 dynes per centimeter.

EXAMPLE 2

For the purpose of comparison, fabric made in accordance with the procedure outlined above for staple yarn was prepared both with and without (control) the fluorochemical emulsion in the spin finish. Fabric made with fibers utilizing the spin finish containing Fluorochemical Composition-1 were characterized by a surface energy of about 18 to 20 dynes per centimeter. Samples of convenient size for processing on Kuster laboratory equipment were prepared with long cotton cloth leaders to enable the sample to be drawn through a chemical pad at simulated process speeds. Pad pressure was adjusted to give approximately 100 percent wet pickup. The test wetting solutions contained 10 grams per liter of water, of Nekal WS-25 and varying amounts of guar gum (see Table III). The test procedure for measuring Kuster liquor (dye solutions) penetration time was as follows:

1. Fabric padded with test wetting solution should be handled carefully and kept flat to avoid "cracking" of the surface and, therefore, channeling of Kuster liquor.
2. Fabric is placed on a flat nonabsorbent surface (polyethylene sheet).
3. An aluminum cylinder [2-inch (5.08 cm) diameter, 3 inches (7.62 cm) high] is pressed firmly into the pile and released.
4. 75 cc of Kuster liquor (dye solution) is then poured rapidly into the cylinder and the stopwatch is started.
5. The stopwatch is stopped as soon as tuft tips are visible in the bottom of the cylinder and the time recorded.
6. This procedure is then repeated two additional times on fresh areas of the test fabric. The three results are then averaged. Results are shown in Table III. Use of at least 0.5 gram per liter of water, of thickening agent brings the Kuster liquor penetration time for the lower surface energy fiber fabric almost up to the time required for the control fabric. Beading has thus been retarded and film formation promoted by increasing the viscosity of the wetting solution.

TABLE III

KUSTER LIQUID PENETRATION TIME (SECONDS)

| Fabric | Guar Concentration (g/l) 0 | 0.5 | 1.5 | 3.0 |
|---|---|---|---|---|
| Control | 31 sec. | 32 sec. | 46 sec. | 47 sec. |
| 18–20 Dynes/cm Fabric | 23 sec. | 31 sec. | 33 sec. | 52 sec. |

I claim:

1. A wetting solution for use in the continuous dyeing of a fabric comprised of synthetic polymer fibers characterized by a surface energy of about 18 to 20 dynes per centimeter, comprising:

(a) water;

(b) about 1.44 to 15.0 grams per liter of water, of a surfactant having a wetting speed factor of up to 1.75; and (c) a sufficient amount of a thickening agent to bring the viscosity of the solution to about 10 to 100 centipoises.

2. The wetting solution of claim 1 wherein the synthetic polymer fibers are polyamide fibers.

3. The wetting solution of claim 1 wherein the synthetic polymer fibers are polyester fibers.

4. The wetting solution of claim 1 wherein the surfactant is a salt of a dialkyl sulfosuccinate.

5. The wetting solution of claim 4 wherein the dialkyl sulfosuccinate is dioctyl sulfosuccinate

6. The wetting solution of claim 5 wherein the salt is a sodium salt.

7. The wetting solution of claim 4 wherein the dialkyl sulfosuccinate is dinonyl sulfosuccinate.

8. The wetting solution of claim 7 wherein the salt is a sodium salt.

9. The wetting solution of claim 4 wherein the salt is an ammonium salt.

10. The wetting solution of claim 4 wherein the salt is an alkali metal salt.

11. The wetting solution of claim 10 wherein the alkali metal salt is a sodium salt.

12. The wetting solution of claim 1 wherein the thickening agent is present in the amount of about 0.5 to 2.5 grams per liter of water.

13. The wetting solution of claim 1 wherein the thickening agent is a natural gum.

14. The wetting solution of claim 13 wherein the gum is guar.

15. The wetting solution of claim 1 wherein the surfactant is present in the amount of about 1.44 to 3.75 grams per liter of water.

16. The wetting solution of claim 1 wherein the surfactant is a salt of a dialkyl sulfosuccinate, and the thickening agent is present in the amount of about 0.5 to 2.5 grams per liter of water.

17. The wetting solution of claim 16 wherein the salt of a dialkyl sulfosuccinate is sodium dioctyl sulfosuccinate, and the thickening agent is a natural gum.

18. The wetting solution of claim 17 wherein the sodium dioctyl sulfosuccinate is present in the amount of about 1.44 to 3.75 grams per liter of water.

19. The wetting solution of claim 18 wherein the synthetic polymer fibers are polyamide fibers.

20. The wetting solution of claim 18 wherein the synthetic polymer fibers are polyester fibers.

21. The wetting solution of claim 16 wherein the salt of a dialkyl sulfosuccinate is sodium dinonyl sulfosuccinate, and the thickening agent is a natural gum.

22. The wetting solution of claim 21 wherein the sodium dinonyl sulfosuccinate is present in the amount of about 1.44 to 3.75 grams per liter of water.

23. The wetting solution of claim 22 wherein the synthetic polymer fibers are polyamide fibers.

24. The wetting solution of claim 22 wherein the synthetic polymer fibers are polyester fibers.

25. The wetting solution of claim 1 wherein the surfactant is an ethoxylated mixture of straight chain $C_9$–$C_{11}$ alcohols.

26. The wetting solution of claim 1 wherein the surfactant is an ethoxylated mixture of straight chain $C_9$–$C_{11}$ alcohols, and the thickening agent is present in the amount of about 0.5 to 2.5 grams per liter of water.

27. The wetting solution of claim 26 wherein the thickening agent is a natural gum.

28. The wetting solution of claim 27 wherein the surfactant is present in the amount of about 1.44 to 3.75 grams per liter of water.

29. The wetting solution of claim 28 wherein the synthetic polymer fibers are polyamide fibers.

30. The wetting solution of claim 28 wherein the synthetic polymer fibers are polyester fibers.

31. A continuous dyeing process for fabric comprised of synthetic polymer fibers characterized by a surface energy of about 18 to 20 dynes per centimeter, comprising the step of prewetting the fabric by immersing it for 0.5 to 2.0 seconds in a solution which comprises: (a) water; (b) about 1.44 to 15.0 grams per liter of water, of a surfactant having a wetting speed factor of up to 1.75; and (c) a sufficient amount of a thickening agent to bring the viscosity of the solution to about 10 to 100 centipoises.

32. The process of claim 31 wherein the synthetic polymer fibers are polyamide fibers.

33. The process of claim 31 wherein synthetic polymer fibers are polyester fibers.

34. The process of claim 31 wherein the surfactant is a salt of dialkyl sulfosuccinate.

35. The process of claim 34 wherein the dialkyl sulfosuccinate is dioctyl sulfosuccinate.

36. The process of claim 35 wherein the salt is a sodium salt.

37. The process of claim 34 wherein the dialkyl sulfosuccinate is dinonyl sulfosuccinate.

38. The process of claim 37 wherein salt is a sodium salt.

39. The process of claim 34 wherein the salt is an ammonium salt.

40. The process of claim 34 wherein the salt is an alkali metal salt.

41. The process of claim 40 wherein the alkali metal salt is a sodium salt.

42. The process of claim 31 wherein the thickening agent is present in the amount of about 0.5 to 2.5 grams per liter of water.

43. The process of claim 31 wherein the thickening agent is a natural gum.

44. The process of claim 43 wherein the gum is guar.

45. The process of claim 31 wherein the surfactant is present in the amount of about 1.44 to 3.75 grams per liter of water.

46. The process of claim 31 wherein the surfactant is a salt of a dialkyl sulfosuccinate, and the thickening agent is present in the amount of about 0.5 to 2.5 grams per liter of water.

47. The process of claim 46 wherein the salt of a dialkyl sulfosuccinate is sodium dioctyl sulfosuccinate, and the thickening agent is a natural gum.

48. The process of claim 47 wherein the sodium dioctyl sulfosuccinate is present in the amount of about 1.44 to 3.75 grams per liter of water.

49. The process of claim 48 wherein the synthetic polymer fibers are polyamide fibers.

50. The process of claim 48 wherein the synthetic polymer fibers are polyester fibers.

51. The process of claim 46 wherein the salt of a dialkyl sulfosuccinate is sodium dinonyl sulfosuccinate, and the thickening agent is a natural gum.

52. The process of claim 51 wherein the sodium dinonyl sulfosuccinate is present in the amount of about 1.44 to 3.75 grams per liter of water.

53. The process of claim 52 wherein the synthetic polymer fibers are polyamide fibers.

54. The process of claim 52 wherein the synthetic polymer fibers are polyester fibers.

55. The process of claim 31 wherein the surfactant is an ethoxylated mixture of straight chain $C_9$–$C_{11}$ alcohols.

56. The process of claim 31 wherein the surfactant is an ethoxylated mixture of straight chain $C_9$–$C_{11}$ alcohols, and the thickening agent is present in the amount of about 0.5 to 2.5 grams per liter of water.

57. The process of claim 56 wherein the thickening agent is a natural gum.

58. The process of claim 57 wherein the surfactant is present in the amount of about 1.44 to 3.75 grams per liter of water.

59. The process of claim 58 wherein the synthetic polymer fibers are polyamide fibers.

60. The process of claim 58 wherein the synthetic polymer fibers are polyester fibers.

* * * * *